US010264856B2

(12) United States Patent
Haas et al.

(10) Patent No.: US 10,264,856 B2
(45) Date of Patent: Apr. 23, 2019

(54) BELT LOCK

(71) Applicant: TRW AUTOMOTIVE GMBH, Alfdorf (DE)

(72) Inventors: Peter Haas, Eschach (DE); Hans-Peter Betz, Böbingen (DE)

(73) Assignee: TRW AUTOMOTIVE GMBH, Alfdorf (DE)

( * ) Notice: Subject to any disclaimer, the term of this patent is extended or adjusted under 35 U.S.C. 154(b) by 0 days.

(21) Appl. No.: 15/100,658

(22) PCT Filed: Nov. 24, 2014

(86) PCT No.: PCT/EP2014/003127
§ 371 (c)(1),
(2) Date: Jun. 1, 2016

(87) PCT Pub. No.: WO2015/082053
PCT Pub. Date: Jun. 11, 2015

(65) Prior Publication Data

US 2016/0302532 A1 Oct. 20, 2016

(30) Foreign Application Priority Data

Dec. 2, 2013 (DE) ..... 10 2013 020 618

(51) Int. Cl.
*A44B 11/25* (2006.01)

(52) U.S. Cl.
CPC ..... *A44B 11/2507* (2013.01); *A44B 11/2523* (2013.01); *A44B 11/2546* (2013.01); *A44B 11/2561* (2013.01)

(58) Field of Classification Search
CPC ..... A44B 11/2507; A44B 11/2561; A44B 11/2546; A44B 11/2515; Y10T 24/45623; Y10T 24/45634; Y10T 24/45644; Y10T 24/4567
See application file for complete search history.

(56) References Cited

U.S. PATENT DOCUMENTS 4,577,378 A 3/1986 Harenberg
4,920,620 A * 5/1990 Yamamoto ..... A44B 11/2523 200/61.58 B
5,704,099 A 1/1998 Cahill
(Continued)

FOREIGN PATENT DOCUMENTS

DE 10259115 7/2004
DE 1020120077987 10/2013
(Continued)

*Primary Examiner* — Robert Sandy
*Assistant Examiner* — Rowland Do
(74) *Attorney, Agent, or Firm* — Tarolli, Sundheim, Covell & Tummino LLP

(57) ABSTRACT

A belt buckle for a vehicle seat belt. The belt buckle includes a frame in which at least one locking element adapted to lock a plug-in tongue insertable into the belt buckle and an ejection element adapted to eject the plug-in tongue are provided. Each of the ejection element and the locking element is adapted to adopt a locked position and a home position. The locking element is adjacent to a web of the ejection element in the home position and thus blocked in its home position. The front end of the web has a ramp-like bearing surface against which the locking element slidingly engages.

19 Claims, 2 Drawing Sheets

(56) References Cited

U.S. PATENT DOCUMENTS

| | | | | |
|---|---|---|---|---|
| 6,477,753 | B1 * | 11/2002 | Burke | B60R 22/48 24/303 |
| 2010/0101060 | A1 * | 4/2010 | Walega | A44B 11/2523 24/603 |
| 2010/0251523 | A1 | 10/2010 | Scharnberg et al. | |
| 2012/0137478 | A1 * | 6/2012 | Nimura | B60R 22/48 24/593.1 |
| 2012/0144630 | A1 * | 6/2012 | Nimura | A44B 11/2523 24/593.1 |
| 2012/0233822 | A1 * | 9/2012 | Wang | A44B 11/2523 24/633 |
| 2012/0324685 | A1 * | 12/2012 | Kataoka | A44B 11/2523 24/637 |
| 2013/0174390 | A1 * | 7/2013 | Muromachi | A44B 11/2523 24/633 |

FOREIGN PATENT DOCUMENTS

| | | | | |
|---|---|---|---|---|
| EP | 0717943 | | 6/1996 | |
| GB | 2148380 | | 5/1985 | |
| JP | 2001231612 | A * | 8/2001 | A44B 11/2523 |
| WO | 2011052414 | | 5/2011 | |
| WO | WO-2012004931 | A1 * | 1/2012 | A44B 11/2515 |

* cited by examiner

BELT LOCK

RELATED APPLICATIONS

This application corresponds to PCT/EP2014/003127, filed Nov. 24, 2014, which claims the benefit of German Application No. 10 2013 020 618.9, filed Dec. 2, 2013, the subject matter of which are incorporated herein by reference in their entirety.

BACKGROUND OF THE INVENTION

The invention relates to a belt buckle for a vehicle seat belt.

A belt buckle is configured to receive and to lock a plug-in tongue arranged on a vehicle seat belt so as to prevent the plug-in tongue from being withdrawn from the belt buckle. For this purpose, the belt buckle includes a locking element adapted to interact with a recess within the plug-in tongue and thus locking the plug-in tongue inside the belt buckle. For transferring the locking element from a home position in which the plug-in tongue is not inserted to a locking position in which the plug-in tongue is inserted and locked, a locking mechanism being triggered by the plug-in tongue during insertion is provided. During insertion the plug-in tongue enters into contact with an ejection element disposed in the belt buckle and displaces the ejection element inside the belt buckle. The plug-in tongue is guided inside the belt buckle by the ejection element.

In the state of the art the ejection element typically includes activating springs triggering the locking mechanism when the plug-in tongue is inserted and accordingly the ejection element is displaced. Hence the locking element is released inside the casing and is displaced so that it engages in the recess of the plug-in tongue so as to inhibit the latter.

For releasing the plug-in tongue a release push-button is pressed. In this way the locking element is reset into the home position again, thus causing the plug-in tongue to be released again. Then the latter will be ejected from the belt buckle via the ejection element.

In the known belt buckles it has turned out to be a drawback that a clicking noise of the activating springs and a locking noise of definitely metallic nature will occur by the triggering of the locking mechanism via the activating springs and the locking by the locking element.

SUMMARY OF THE INVENTION

Therefore it is the object of the invention to design a belt buckle in such way that the noise during locking the belt buckle is reduced.

The object of the invention is achieved by a belt buckle for a vehicle seat belt comprising a frame in which at least one locking element adapted to lock a plug-in tongue insertable into the belt buckle and an ejection element adapted to eject the plug-in tongue are provided, wherein each of the ejection element and the locking element is adapted to adopt a locked position and a home position, the locking element being adjacent to the ejection element in the home position and thus being blocked in its home position. The principal idea of the invention consists in minimizing the noise occurring during locking by reducing the velocity of the locking element during locking. This will work due to the fact that the distance of the locking element from the home position to the locked position is minimized, as the locking element is directly adjacent to the ejection element. The lower velocity entails lower impact energy so that the noise occurring during locking is reduced. Moreover, a simpler structure is resulting as no complicated mechanism has to be provided for retaining the locking element in the home position. There is simply used the ejection element to retain the locking element in the home position.

Another aspect of the invention provides that the ejection element can be transferred by the plug-in tongue to the looked position in which the election element releases the locking element so that the locking element can reach the looked position and latch the plug-in tongue. According to the locking mechanism no activating springs triggering the locking mechanism are required at the ejection element. The clicking noise otherwise typically generated by the activating springs does not exist, causing the noise occurring altogether during locking to be further reduced. In addition, the assembly of the belt buckle is simplified, because the release mechanism for the looking element is definitely facilitated.

According to another aspect of the invention it is provided that the ejection element and/or the locking member are biased via a spring element, especially that the locking element is biased against the election element. It is ensured by the bias that the locking element, if released, passes into its locked position so as to guarantee safe latching of the plug-in tongue inside the belt buckle. This is independent of the mounting position of the belt buckle. Via the bias of the election element the inserted plug-in tongue may be ejected from the belt buckle in a simple manner.

Another aspect of the invention provides that the ejection element includes a web to which the locking element is adjacent in the home position. The length of the web allows adjusting when the locking element is released by the ejection element and passes to the locked position especially due to the bias. The web provided at the ejection element is typically configured corresponding to the length from the end of the plug-in tongue to the recess within the plug-in tongue so that the locking element can directly engage in the recess as soon as it is no longer retained in the home position by the ejection element.

Especially the ejection element substantially includes an H-shaped cross-section. The ejection element includes two webs connected approximately in the center by a cross web. At said cross web a stop surface for the plug-in tongue and, on the opposite side, a support surface for the spring element biasing the ejection element may be formed.

Another aspect of the invention provides a damping element adapted to interact with the locking element, especially by decelerating the movement of the locking element in a damping manner. The additional damping element causes the locking element to be decelerated in a comparatively smooth manner at the end of its adjustment travel from the home position into the locking position thereby the locking noise being further reduced.

According to an aspect of the invention, the damping element is arranged on a casing, especially on an inner surface of the casing. This facilitates the damping of the locking element, as the noise occurring during locking is mainly developed by interaction of the locking element and the casing.

Another aspect provides that the damping element is provided in an indentation in the casing, especially in an indentation facing the locking element. It is achieved in this way that the locking element directly impinges on the damping element when it passes into its locked position, thus causing the movement of the locking element to be decelerated and the locking element not to impinge on the casing. It is moreover ensured by the arrangement within the indentation that the ejection element may move unobstructed in the belt buckle.

According to an aspect of the invention, the damping element is a rubber or foam element, especially a PU foam element. These materials are especially well suited for decelerating the impact energy of the locking element and for simultaneously reducing noise.

Especially the damping element is formed of an injection-molded material that has been injected directly into the casing. In this way the damping element can be configured in a simple way during manufacture of the belt buckle casing.

BRIEF DESCRIPTION OF THE DRAWING

Further characteristics and advantages of the invention will be evident from the following description and the drawings which are referred to and in which.

DESCRIPTION

Figure 1:
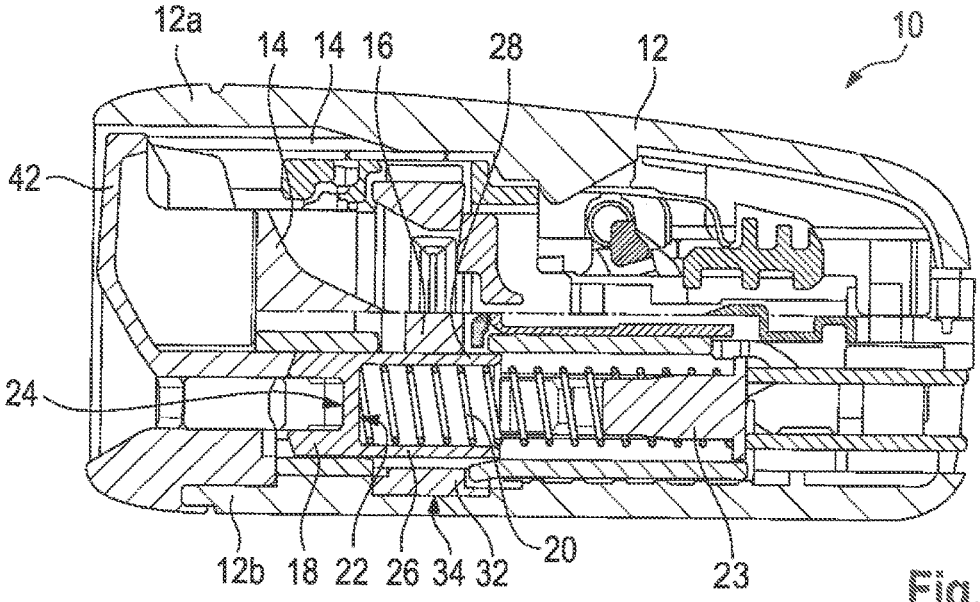
FIG. 1 shows a cross-sectional view of a belt buckle according to the invention in the home position.

In FIG. 1 a belt buckle 10 is shown in a cross-sectional view in its home position. The belt buckle 10 includes a casing 12 formed of two casing shells 12*a*, 12*b*. In the casing 12*a* locking mechanism is provided in a frame 14 constituting the self-supporting structure of the belt buckle 10. The locking mechanism comprises at least one locking element 16 as well as one election element 18.

Figure 2:
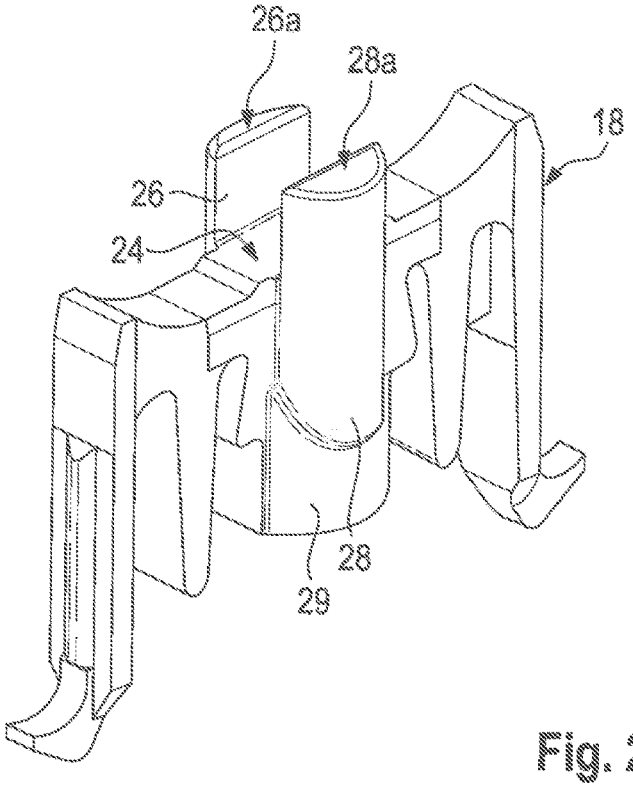
FIG. 2 shows the ejection element.

The ejection element 18 illustrated in detail in FIG. 2 is arranged to be movable within the frame 14 and serves for ejecting a plug-in tongue inserted in the belt buckle from the same after pressing a release button at the belt buckle. For this purpose, the ejection element 18 interacts with a spring element 20 which loads the former into its home position (to the left in FIG. 1). The spring element 20 rests on a support surface 22 of the ejection element 18 and is supported on a casing part 23.

A stop surface 24 serving as stop for a plug-in tongue not shown here is formed at the ejection element 18 opposite to the support surface 22. The ejection element 18 further includes two webs 26, 28 projecting from the stop surface 24 while facing each other. When a plug-in tongue is inserted in the belt buckle, its front end is located between the two webs 26, 28.

One of the two webs 28, 28 is assigned to the locking element 16 so that it retains the locking element 16 in the home position when the ejection element 18 is provided in the home position.

On the front end of the webs 26, 28 ramp-like bearing surfaces 26*a*, 28*a* are formed. The webs 26, 28 in total have a pitch circle cross-section, wherein the surface assigned to the stop face 24 is planar.

The spring element 20 is adjacent the ejection element 18, namely at the bottom of a receiving sleeve 29 which is integrally formed with the ejection element 18 on the side facing away from the webs 26, 28. The webs 26, 28 directly merge with the wall of the receiving sleeve 29 which receives the spring element 20.

Figure 3:
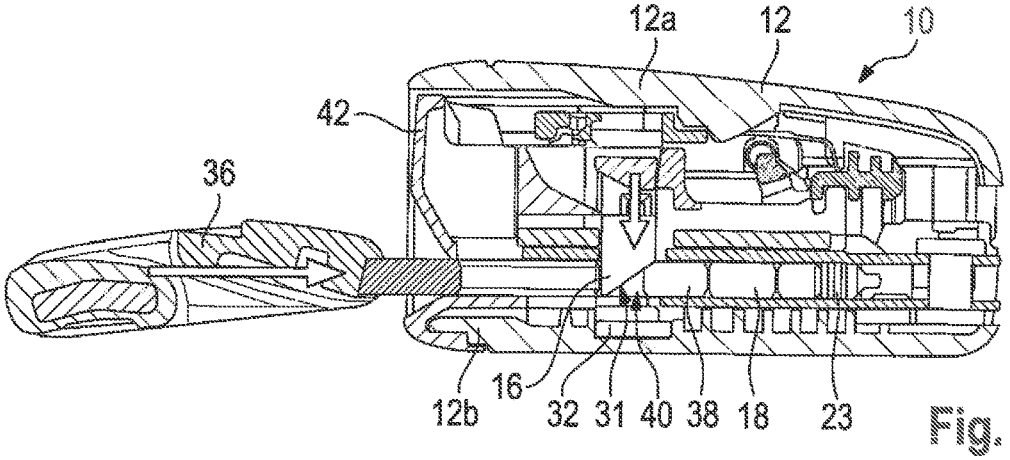
FIG. 3 shows another cross-sectional view of the belt buckle according to the invention in a first intermediate position while a plug-in tongue is inserted.
Figure 4:
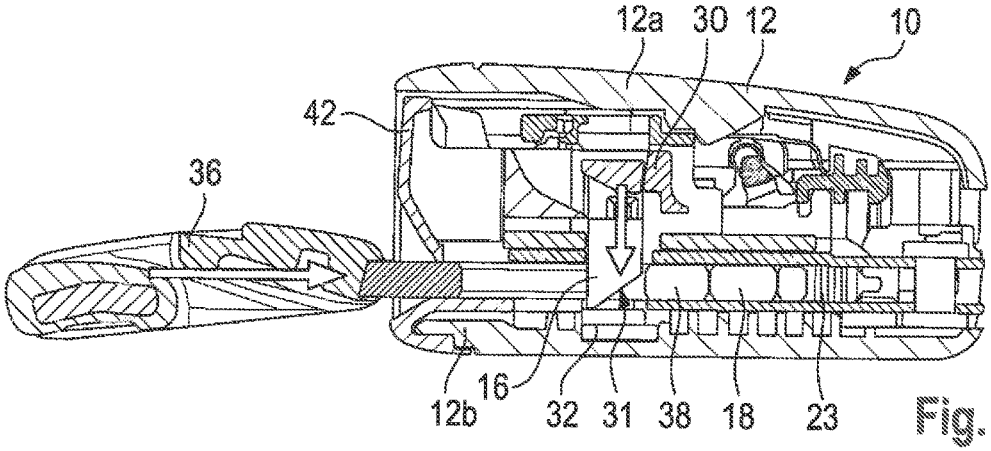
FIG. 4 shows another cross-sectional view of the belt buckle according to the invention in a second intermediate position with the plug-in tongue being further inserted.
Figure 5:
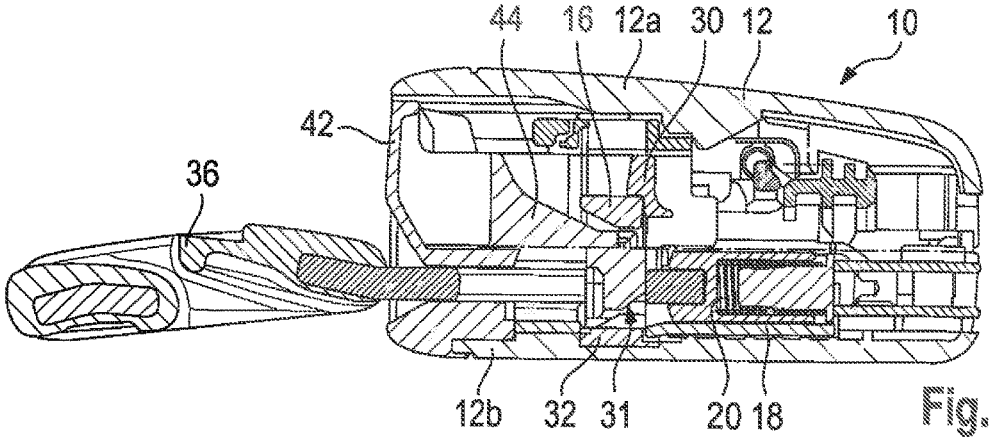
FIG. 5 shows the belt buckle of FIG. 1 with a plug-in tongue being locked therein.

The locking element 16, too, is biased into its looked position by means of a spring, namely by means of a spring element 30 (FIGS. 3 to 5). By virtue of the bias the locking element 16 is pressed against the web 28 of the ejection element 18 assigned to the locking element 16 so that the locking element 16 is in direct contact with the ejection element 18. The locking element 16 is retained in its home position against the bias by the ejection element 18. For the purpose of contact the locking element 16 exhibits a contact face 31 that is inclined relative to its longitudinal orientation (FIG. 2).

The spring element 30 may be in the form of a spiral spring, leaf spring or resilient member. In the illustrated embodiment the spring element 30 is in the form of a resilient metal strip.

Furthermore, a damping element 32 arranged in an indentation 34 of the casing shell 12*b* is provided within the casing 12. The damping element 32 is positioned opposite to the locking element 16, wherein, in the home position of the belt buckle 10, the ejection element 18 is located between the locking element 16 and the damping element 32.

The damping element 32 may be a rubber or foam element which may have been injected into the indentation 34 during manufacture of the casing shell 12*b*. As an alternative, it is provided that the damping element is in the form of an insertion member being glued into the casing shell.

When inserting a plug-in tongue 36 (FIGS. 3 to 5) the front end 38 of the plug-in tongue provided with a recess 40 for the locking element 16 enters into contact with the ejection element 18, causing it to be displaced by the plug-in tongue 36 inside the casing 12. In this way, the belt buckle 10 in general, the locking element 16 and the ejection element 18 are transferred from their home positions into their locked positions as shown in FIG. 5.

The belt buckle further includes, for releasing the plug-in tongue 36, a push-button 42 adapted to be actuated for moving the locking element 16 via a link guide 44 against the bias of the spring element 30.

The transition from the home position (FIG. 1) to the locked position (FIG. 5) takes place as follows, wherein the FIGS. 3 and 4 illustrate intermediate positions representing a sectional plane different from that of FIGS. 1 and 2:

The plug-in tongue 36 is inserted into the belt buckle 10 (FIG. 3). The plug-in tongue 36 enters into contact with the end 38 at the stop face 24 of the ejection element 18 and then pushes the election element 18 inside the belt buckle 10 to the right toward the casing part 23.

During displacement of the ejection element 18 within the belt buckle 10 the spring element 20 arranged at the ejection element 18 is compressed. The locking element 16 first continues being adjacent to the ejection element 18, especially to the web 28, during displacement of the ejection element 18.

When the election element 18 is displaced so far that the looking element 16 has arrived at the end of the web 28, the looking element 16 slides over the contact face 31 inclined relative to its longitudinal orientation along the end of the web 28 into its locked position (FIGS. 3 and 4). The sliding is further improved by the fact that the ramp-like bearing surface 28*a* is configured to correspond to the contact face 31 at the end of the web 28 so that smooth sliding of the locking element 16 is resulting.

After the locking element 16 has slipped along the end of the web 28, it is pressed through the recess 40 which then is arranged below the locking element 16 by the spring element 30 so that the plug-in tongue 38 is locked in the belt buckle 10.

This movement is ensured by virtue of the bias by the spring element 30 so that it takes place independently of the mounting position. The movement of the locking element 16 during locking is reduced by the sliding at the end of the web 28 as, compared to the state of the art, the distance covered by the locking element 18 from the home position into the locked position without deceleration and under the effect of the spring element 30 is reduced. In this way the impact energy of the locking element arriving at the locked position is reduced. Thus the related noise is reduced.

At the end of the stroke into the locked position, the locking element 16 impinges on the damping element 32, thus causing the impact energy to be partly taken up and absorbed by the damping element 32. The occurring noise is further reduced in this way as the locking element 16 does not directly impinge on the casing 12.

Upon actuation of the push-button 42 the locking element is moved over the link guide 44 and is disengaged from the recess 40 of the plug-in tongue 36 again. Due to the bias of the spring element 20, then the ejection element 18 is loaded into its home position (FIG. 1) again and the socking element 16 is adjacent to the ejection element 18.

The invention claimed is:

1. A belt buckle (10) for a vehicle seat belt comprising a frame (14) in which at least one locking element (16) adapted to lock a plug-in tongue (36) insertable into the belt buckle (10) and an ejection element (18) adapted to eject the plug-in tongue (36) are provided, wherein each of the ejection element (18) and the locking element (16) is adapted to adopt a locked position and a home position, the locking element (16) being adjacent to a web (28) of the ejection element (18) in the home position and thus being blocked in its home position, and wherein the front end of the web (28) has a ramp-like bearing surface (28*a*) against which the locking element (16) slidingly engages, the locking element being spaced from the entire ramp-like bearing surface in the home position.

2. The belt buckle (10) according to claim 1, wherein the ejection element (18) can be transferred by the plug-in tongue (36) into the locked position in which the ejection element (18) releases the locking element (16) so that the locking element (16) may arrive at the locked position and lock the plug-in tongue (36).

3. The belt buckle (10) according to claim 1, wherein the locking element (16) is biased via a spring element (30) against the ejection element (18).

4. The belt buckle (10) according to claim 1, wherein the ejection element (18) has an H-shaped cross-section.

5. The belt buckle (10) according to claim 1, wherein a damping element (32) which is adapted to interact with the locking element (16), by decelerating the movement of the locking element (16) in a damping manner, is provided.

6. The belt buckle (10) according to claim 5, wherein the damping element (32) is arranged on an inner surface of a casing (12).

7. The belt buckle (10) according to claim 5, wherein the damping element (32) is provided in an indentation (34) within a casing (12) in an indentation (34) facing the locking element (16).

8. The belt buckle (10) according to claim 5, wherein the damping element (32) is a rubber or foam element.

9. The belt buckle (10) according to claim 5, wherein the damping element (32) is formed of an injection molding material that has been injected directly into a casing (12).

10. The belt buckle (10) according to claim 1, wherein the ejection element (18) is biased via a spring element (30).

11. A belt buckle into which a plug-in tongue can be inserted, the belt buckle comprising:

a locking element moveable between a home position and a locked position, the locking element permitting the plug-in tongue to be withdrawn from the belt buckle when the locking element is in the home position, the locking element locking the plug-in tongue in the belt buckle when the locking element is in the locked position;

a casing that houses the locking element and the ejection element;

a damping element provided on an inner surface of the casing, the damping element decelerating movement of the locking element during movement of the locking element from the home position to the locked position; and an ejection element being moveable from a first position to a second position to eject the plug-in tongue from the belt buckle, the ejection element retaining the locking element in the home position.

12. The belt buckle according to claim 11, wherein the locking element is in direct contact with the ejection element when the locking element is in the home position.

13. The belt buckle according to claim 11, wherein insertion of the plug-in tongue into the belt buckle moves the ejection element from the second position to the first position to release the locking element and allow the locking element to move from the home position to the locked position.

14. The belt buckle according to claim 11, wherein a spring element biases the locking element into contact with the ejection element.

15. The belt buckle according to claim 11, wherein the ejection element has an H-shaped cross-section.

16. The belt buckle according to claim 11, wherein the ejection element is biased by a spring element.

17. The belt buckle according to claim 11, wherein the damping element is provided in an indentation of the casing that faces the locking element.

18. The belt buckle according to claim 11, wherein the damping element is a rubber or foam element.

19. The belt buckle according to claim 11, wherein the damping element is formed of an injection molding material that is directly injected into the casing.

* * * * *